US011774099B2

(12) United States Patent
Jones et al.

(10) Patent No.: US 11,774,099 B2
(45) Date of Patent: Oct. 3, 2023

(54) GAS TURBINE FUEL NOZZLE TIP COMPRISING AN IMPINGEMENT WALL

(71) Applicant: General Electric Company, Schenectady, NY (US)

(72) Inventors: Charlie Edmond Jones, Greenville, SC (US); Lucas John Stoia, Greenville, SC (US); Homayoon Feiz, Greenville, SC (US); Anthony Michael DiNardi, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/852,617

(22) Filed: Jun. 29, 2022

(65) Prior Publication Data

US 2023/0003384 A1 Jan. 5, 2023

Related U.S. Application Data

(60) Provisional application No. 63/216,676, filed on Jun. 30, 2021.

(51) Int. Cl.
*F23R 3/14* (2006.01)
*F23R 3/28* (2006.01)

(52) U.S. Cl.
CPC ..... *F23R 3/286* (2013.01); *F23R 3/14* (2013.01); *F23R 3/283* (2013.01)

(58) Field of Classification Search
CPC .... F23R 3/14; F23R 3/28; F23R 3/283; F23R 3/286; F23R 3/34; F23R 3/343; F23R 3/346; F23R 3/36
See application file for complete search history.

(56) References Cited

U.S. PATENT DOCUMENTS

| | | | | |
|---|---|---|---|---|
| 8,464,537 | B2 | 6/2013 | Khan et al. | |
| 8,607,570 | B2 | 12/2013 | Hadley et al. | |
| 9,188,341 | B2 | 11/2015 | McMasters et al. | |
| 9,383,107 | B2 | 7/2016 | Shershnyov et al. | |
| 9,927,126 | B2 | 3/2018 | Benjamin et al. | |
| 10,443,854 | B2 | 10/2019 | Grooms et al. | |
| 10,458,655 | B2 | 10/2019 | Boardman et al. | |
| 10,907,832 | B2 | 2/2021 | Zajadatz et al. | |
| 2006/0027232 | A1* | 2/2006 | Parker | F23R 3/283 126/349 |
| 2010/0095677 | A1* | 4/2010 | Dawson | F23R 3/343 60/752 |

(Continued)

*Primary Examiner* — William H Rodriguez
(74) *Attorney, Agent, or Firm* — Dority & Manning, P.A.

(57) ABSTRACT

A fuel nozzle includes a center body that extends from an upstream end to a downstream end. A nozzle tip, which is fixedly coupled to the downstream end of the center body, includes an outer annular wall that has a forward end and an aft end. A solid aft wall is disposed at the aft end of the outer annular wall. The solid aft wall and the outer annular wall at least partially define a plenum. A nozzle portion, which is disposed within the plenum, includes an inner annular wall and an impingement wall. The impingement wall is spaced apart from the solid aft wall and defines a plurality of apertures configured to direct fluid to impinge upon the solid aft wall. A plurality of outlets is defined in the outer annular wall forward of the solid aft wall to direct post-impingement fluid from the nozzle tip.

20 Claims, 5 Drawing Sheets

(56) References Cited

U.S. PATENT DOCUMENTS

| | | | | |
|---|---|---|---|---|
| 2010/0101229 | A1* | 4/2010 | York | F23R 3/283 60/737 |
| 2012/0180490 | A1* | 7/2012 | Takami | F23R 3/36 239/132.3 |
| 2014/0020389 | A1* | 1/2014 | Melton | F23R 3/46 60/722 |
| 2014/0116060 | A1* | 5/2014 | Melton | F23R 3/283 60/755 |
| 2014/0116066 | A1* | 5/2014 | Melton | F23D 11/36 60/737 |
| 2014/0190168 | A1* | 7/2014 | Shershnyov | F23R 3/283 60/737 |
| 2016/0054003 | A1* | 2/2016 | Carnell, Jr. | F23R 3/002 60/740 |
| 2016/0146460 | A1* | 5/2016 | Stewart | F23R 3/36 60/737 |
| 2016/0313006 | A1* | 10/2016 | Stewart | F23R 3/343 |
| 2017/0082290 | A1* | 3/2017 | Stewart | F23R 3/12 |
| 2017/0363294 | A1 | 12/2017 | Grooms et al. | |
| 2018/0266694 | A1* | 9/2018 | Johnson | F23R 3/14 |
| 2022/0228741 | A1* | 7/2022 | Jeong | F23R 3/286 |
| 2022/0372913 | A1* | 11/2022 | Nath | F23R 3/10 |

* cited by examiner

GAS TURBINE FUEL NOZZLE TIP COMPRISING AN IMPINGEMENT WALL

PRIORITY STATEMENT

The present application claims priority to U.S. Provisional Patent Application Ser. No. 63/216,676, filed Jun. 30, 2021, which is incorporated by reference herein in its entirety.

FIELD

The present disclosure relates generally to a fuel nozzle for use in a turbomachine. In particular, the present disclosure relates to a fuel nozzle having a nozzle tip with increased durability.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The expanded combustion gases (i.e., exhaust gases) then exit the gas turbine via the exhaust section.

Typically, fuel nozzles are employed in the combustion section for mixing fuel and air prior to ignition within the combustion section. As such, the fuel nozzles are generally disposed in close proximity to the high temperature combustion gases and therefore experience thermal stresses during operation of the turbomachine. Particularly, the aft ends of the fuel nozzles, which are closest to the combustion gases, experience the most thermal stress. In some operational instances, the thermal stresses can cause cracking or damage to the fuel nozzles.

Accordingly, an improved fuel nozzle is desired in the art. In particular, an improved fuel nozzle having means for reducing or entirely preventing damage-causing thermal stresses would address long-felt needs in the industry.

BRIEF DESCRIPTION

Aspects and advantages of the fuel nozzles and combustors in accordance with the present disclosure will be set forth in part in the following description, or may be obvious from the description, or may be learned through practice of the technology.

In accordance with one embodiment, a fuel nozzle for a turbomachine is provided. The fuel nozzle includes a center body that has a tube shape and that extends from an upstream end to a downstream end. A nozzle tip is fixedly coupled to the downstream end of the center body. The nozzle tip includes an outer annular wall that has a forward end and an aft end. The forward end of the outer annular wall is fixedly coupled to the downstream end of the center body. A solid aft wall is disposed at the aft end of the outer annular wall. The solid aft wall and the outer annular wall at least partially define a plenum. A nozzle portion, which is disposed within the plenum, includes an inner annular wall and an impingement wall. The impingement wall is spaced apart from the solid aft wall and defines a plurality of apertures configured to direct fluid to impinge upon the solid aft wall. A plurality of outlets is defined in the outer annular wall forward of the solid aft wall.

In accordance with another embodiment, a combustor is provided. The combustor includes an end cover and a plurality of fuel nozzles connected to the end cover and annularly arranged around a centerline of the end cover. Each fuel nozzle includes a center body that has a tube shape and that extends from an upstream end to a downstream end. A nozzle tip is fixedly coupled to the downstream end of the center body. The nozzle tip includes an outer annular wall that has a forward end and an aft end. The forward end of the outer annular wall is fixedly coupled to the downstream end of the center body. A solid aft wall is disposed at the aft end of the outer annular wall. The solid aft wall and the outer annular wall at least partially define a plenum. A nozzle portion, which is disposed within the plenum, includes an inner annular wall and an impingement wall. The impingement wall is spaced apart from the solid aft wall and defines a plurality of apertures configured to direct fluid to impinge upon the solid aft wall. A plurality of outlets is defined in the outer annular wall forward of the solid aft wall.

These and other features, aspects, and advantages of the present fuel nozzles and combustors will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present fuel nozzles and combustors, including the best mode of making and using the present systems and methods, directed to one of ordinary skill in the art, is set forth in the specification, which makes reference to the appended figures, in which.

DETAILED DESCRIPTION

Figure 1:
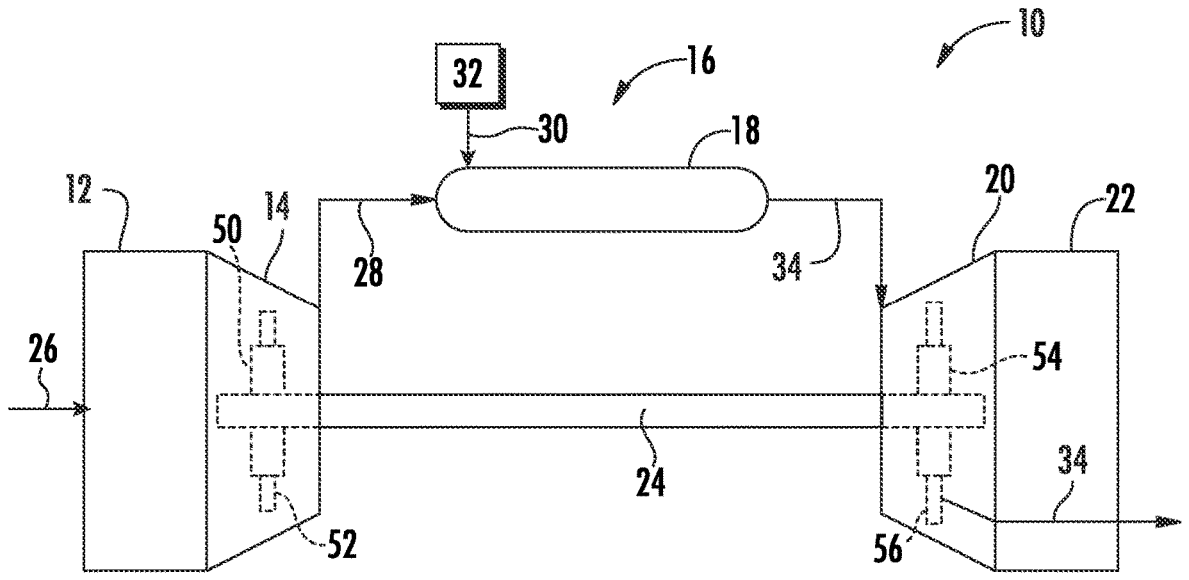
FIG. 1 is a schematic illustration of a turbomachine, in accordance with embodiments of the present disclosure.

Reference now will be made in detail to embodiments of the present fuel nozzles and combustors, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component. Terms of approximation, such as "generally," "substantially," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Referring now to the drawings, FIG. 1 illustrates a schematic diagram of one embodiment of a turbomachine, which in the illustrated embodiment is a gas turbine engine 10. Although an industrial or land-based gas turbine engine is shown and described herein, the present disclosure is not limited to a land-based and/or industrial gas turbine unless otherwise specified in the claims. For example, the fuel nozzle and combustor as described herein may be used in any type of turbomachine including, but not limited to, an aircraft gas turbine or a marine gas turbine.

As shown, the gas turbine engine 10 generally includes an inlet section 12, a compressor section 14 disposed downstream of the inlet section 12, a combustion section 16 including at least one combustor 18 disposed downstream of the compressor section 14, a turbine section 20 disposed downstream of the at least one combustor 18 and an exhaust section 22 disposed downstream of the turbine section 20. Additionally, the gas turbine engine 10 may include one or more shafts 24 that couple the compressor section 14 to the turbine section 20.

The compressor section 14 may generally include a plurality of rotor disks 50 (one of which is shown) and a plurality of rotor blades 52 extending radially outwardly from and connected to each rotor disk 50. Each rotor disk 50 in turn may be coupled to or form a portion of the shaft 24 that extends through the compressor section 14. The turbine section 20 may generally include a plurality of rotor disks 54 (one of which is shown) and a plurality of rotor blades 56 extending radially outwardly from and being interconnected to each rotor disk 54. Each rotor disk 54 in turn may be coupled to or form a portion of the shaft 24 that extends through the turbine section 20.

During operation, air 26 flows through the inlet section 12 and into the compressor section 14 where the air 26 is progressively compressed through stages of rotating blades 52 and stationary nozzles (not shown), thus providing compressed air 28 to the combustor 18. A fuel 30 from a fuel supply 32 is injected into the combustor 18, mixed with a portion of the compressed air 28 and burned to produce combustion gases 34. The combustion gases 34 flow from the combustor 18 into the turbine section 20, wherein energy (kinetic and/or thermal) is transferred from the combustion gases 34 to rotor blades 54 arranged in stages with stationary nozzles (not shown), thus causing shaft 24 to rotate. The mechanical rotational energy may then be used for various purposes such as to power the compressor section 14 and/or to generate electricity via a generator (not shown). The combustion gases 34 exiting the turbine section 20 (i.e., exhaust gases) may be exhausted from the gas turbine engine 10 via the exhaust section 22.

Figure 2:
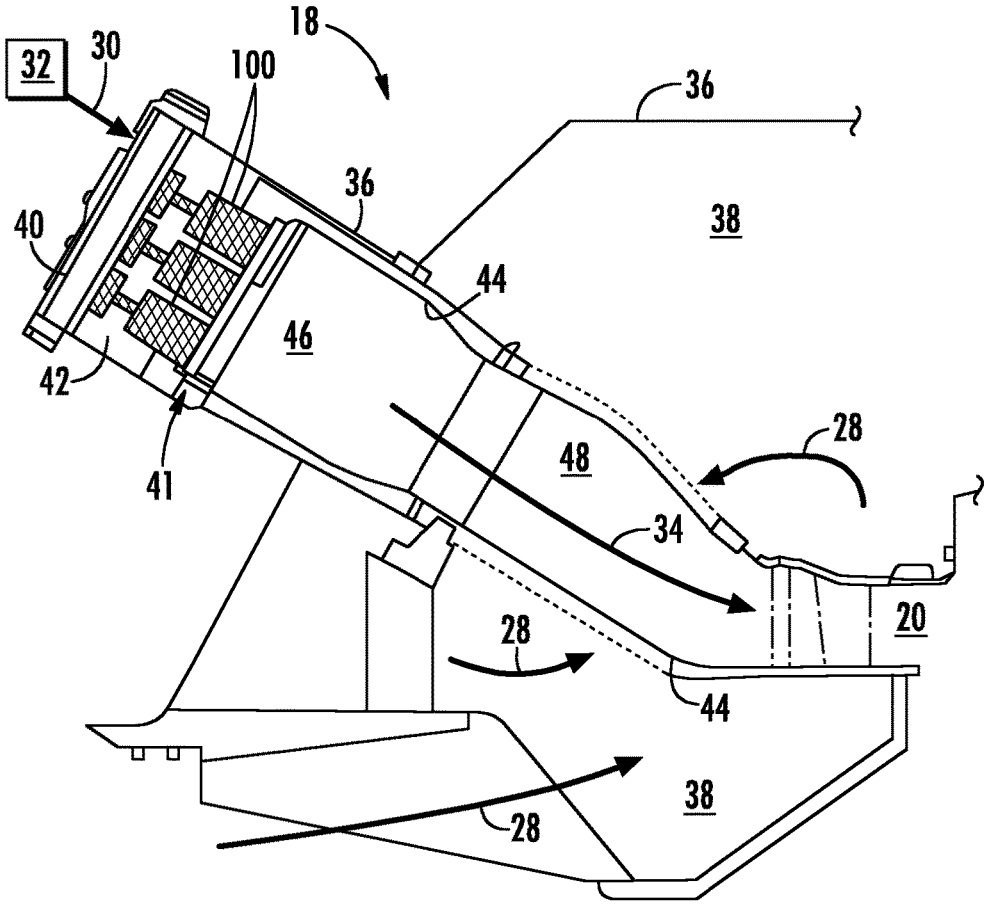
FIG. 2 illustrates a cross-sectional side view of an exemplary combustor, in accordance with embodiments of the present disclosure.

FIG. 2 provides a cross-sectional side view of an exemplary combustor 18 as may incorporate various embodiments of the present disclosure. As shown in FIG. 2, the combustor 18 may be at least partially surrounded by an outer casing 36 such as a compressor discharge casing. The outer casing 36 may at least partially define a high pressure plenum 38 that at least partially surrounds various components of the combustor 18. The high pressure plenum 38 may be in fluid communication with the compressor section 14 (FIG. 1) to receive at least a portion of the compressed air 28 therefrom.

An end cover 40 may be coupled to the outer casing 36. In particular embodiments, the outer casing 36 and the end cover 40 may at least partially define a head end volume or chamber 42 of the combustor 18. In particular embodiments, the head end volume 42 is in fluid communication with the high pressure plenum 38 and the compressor section 14. One or more liners or ducts 44 may at least partially define a combustion chamber or zone 46 for combusting a fuel-air mixture and may at least partially define a hot gas path 48 through the combustor 18 for directing the combustion gases 34 towards an inlet to the turbine section 20.

Figure 3:
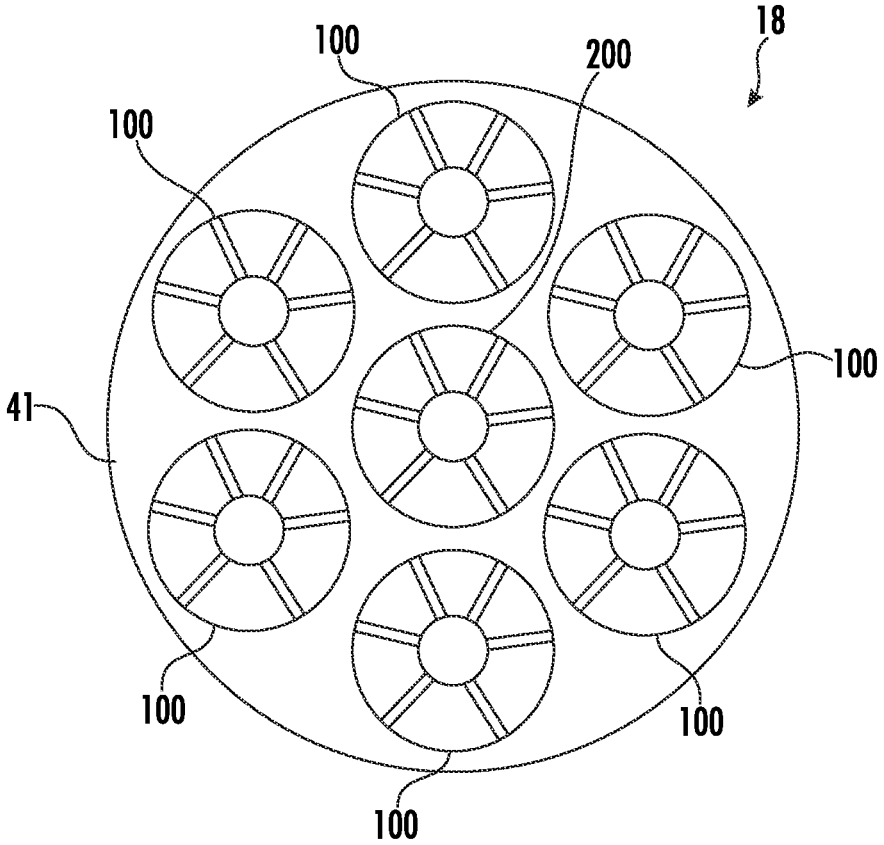
FIG. 3 illustrates an upstream plan view of a head end portion of the combustor shown in FIG. 2, in accordance with embodiments of the present disclosure.

FIG. 3 provides an upstream plan view of a head end portion of the combustor 18 shown in FIG. 2. In various embodiments, as shown in FIGS. 2 and 3 collectively, the combustor 18 includes multiple fuel nozzles (e.g., 100) whose upstream ends are coupled to the end cover 40 and which extend through the head end plenum 42 toward the combustion chamber 46. The downstream ends of the fuel nozzles (e.g., 100) are aligned with respective openings (not shown) in a cap assembly 41, such that the fuel nozzles (e.g., 100) deliver a fuel-air mixture through the cap assembly 41 to the combustion chamber 46.

Various embodiments of the combustor 18 may include different numbers and arrangements of fuel nozzles, and the presently described embodiments are not limited to any particular number of fuel nozzles unless otherwise specified in the claims. For example, in a particular configuration shown in FIG. 3, the one or more fuel nozzles includes multiple primary (or outer) fuel nozzles 100 annularly arranged about a center (or central) fuel nozzle 200. The downstream ends of the fuel nozzles 100, 200 are aligned with respective openings (not shown) in the cap assembly 41, such that the fuel nozzles 100, 200 deliver fuel through the cap assembly 41 to the combustion chamber 46.

Figure 4:
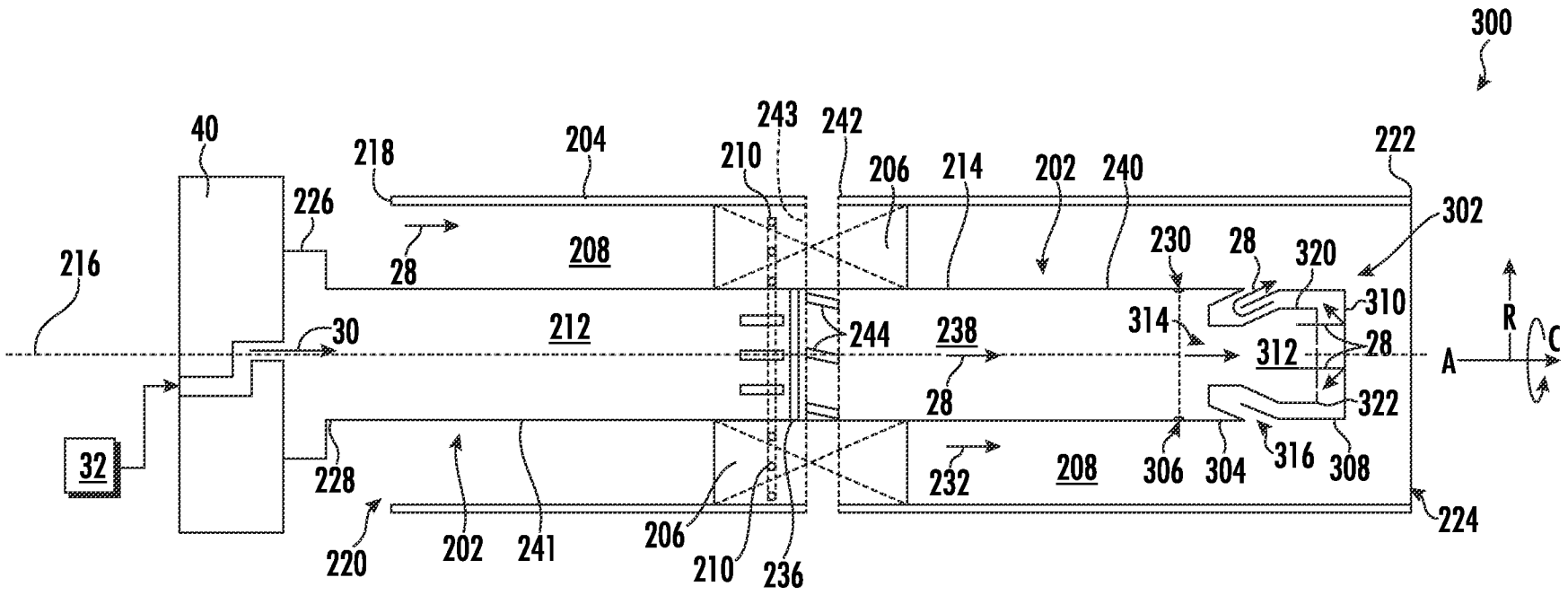
FIG. 4 illustrates a cross-sectional side view of a fuel nozzle useful with the combustor shown in FIG. 2, in accordance with embodiments of the present disclosure.

FIG. 4 provides a cross-sectional side view of an exemplary fuel nozzle 300 according to at least one embodiment of the present disclosure. The fuel nozzle 300 shown in FIG. 4 may be one of an outer fuel nozzle 100 or a central fuel nozzle 200. As shown, the fuel nozzle 300 includes a center body 202 having an annular or tube shape. In particular embodiments, the fuel nozzle 300 may include a burner tube 204 that extends circumferentially around at least a portion of the center body 202 and a plurality of turning vanes 206 that extend between the center body 202 and the burner tube 204. The turning vanes 206 are disposed within an annular or premix passage 208, which is defined radially between the center body 202 and the burner tube 204. In particular embodiments, one or more of the turning vanes 206 includes a respective fuel port 210, which is in fluid communication with a fuel passage 212 defined within the center body 202. The fuel passage 212 is fluidly coupled to a fuel supply 32 (FIG. 4) to receive a fuel 30 therefrom (such as a gaseous fuel or liquid fuel). In certain embodiments, the fuel passage 212 may be defined by the center body 202 upstream from a partition 236. In such embodiments, the turning vanes 206 may receive fuel directly from the center body 202.

The center body 202 may be formed from one or more sleeves or tubes 214 coaxially aligned with a longitudinal axis or axial centerline 216 of the fuel nozzle 300. As shown, the center body 202 may extend (e.g., axially) from an upstream end 228 to a downstream end 230. In some embodiments, the axial centerline 216 of the fuel nozzle 300 may be coincident with an axial centerline through the end cover 40 (e.g., if the fuel nozzle 300 is a center fuel nozzle 200). In other embodiments, the axial centerline 216 of the fuel nozzle 300 may be generally parallel to the axial centerline through the end cover 40. The fuel nozzle 300 may be connected to an inner surface of the end cover 40 via mechanical fasteners or by other connecting means (not shown). For example, the fuel nozzle 300 may include a flange 226 at the upstream end 228 of the center body 202 for coupling to the end cover 40. In other embodiments (not shown), the upstream end 228 of the fuel nozzle 300 may couple directly to the end cover 40.

In particular embodiments, as shown in FIG. 4, a forward end 218 of the burner tube 204 may at least partially define an inlet 220 to the premix passage 208, and an aft end 222 of the burner tube 204 may at least partially define an outlet 224 of the premix passage 208. In at least one embodiment, the inlet 220 is in fluid communication with the head end volume 42 (FIG. 2) of the combustor 18, such that the inlet 220 receives compressed air 28 from the head end volume 42. The compressed air 28 within the premix passage 208 may be induced into a swirl by the turning vanes 206, where fuel 30 is introduced through the fuel ports 210 to form a fuel-air mixture 232.

As shown in FIG. 4, the partition 236 may be disposed at the axial aft end of fuel passage 212 (e.g., downstream of the fuel ports 210). The partition 236 functions to prevent fuel 30 from the fuel passage 212 from flowing into an air plenum 238 defined by the center body 202. In this way, the partition 236 may be a solid wall or structure that extends entirely across (e.g., radially) the center body 202 and that divides and/or fluidly isolates the fuel passage 212 from the air plenum 238. In some embodiments, an upstream portion 241 of the center body 202 may extend between the flange 226 and the partition 236. The upstream portion 241 of the center body 202 may define the fuel passage 212. Additionally, a downstream portion 240 of the center body 202 may extend between the partition 236 and the downstream end 230 of the center body 202. The downstream portion 240 of the center body 202 may define the air plenum 238. The partition 236 may be disposed directly between the upstream portion 241 and the downstream portion 240 such that the partition 236 forms a boundary between the fuel passage 212 and the air plenum 238 (such that no fuel enters the air plenum 238 or vice versa).

In many embodiments, the air plenum 238 may receive the air 28 from the head end volume 42 (FIG. 2) via one or more conduits 243 extending through each turning vane 206. For example, each conduit 243 may be collectively defined by the burner tube 204, a turning vane 206 of the plurality of turning vanes 206, and the center body 202 to provide for fluid communication between the head end volume 42 and the air plenum 238. Particularly, a conduit 243 may extend through each turning vane 206 to provide for fluid communication between the head end volume 42 and the air plenum 238. For example, each conduit 243 may extend between an inlet opening 242 defined in the burner tube 204 and an outlet opening 244 defined in the center body 202. Particularly, each conduit 243 may extend from an inlet opening 242, through a respective turning vane 206, to an outlet opening 244 to provide for fluid communication (e.g., direct fluid communication) between the head end volume 42 and the air plenum 238. In various embodiments, the partition 236 may be disposed axially between the fuel ports 210 (on the upstream side of the partition 236) and the conduits 243 (on the downstream side of the partition 236).

In exemplary embodiments, the fuel nozzle 300 may further include a nozzle tip 302 coupled to the downstream end 230 of the center body 202 for introducing a second flow of air 28 into the premix passage 208 upstream from the aft end 222 of the burner tube 204. This may advantageously increase the mixedness of the fuel-air mixture 232 within the premix passage 208 prior to combustion. For example, the nozzle tip 302 may be disposed within the burner tube 204 (e.g., such that a most downstream surface of the nozzle tip 302 is upstream from the aft end 222). In various embodiments, the nozzle tip 302 may be welded, brazed, or otherwise fixedly coupled to the downstream end 230 of the center body 202.

Figure 5:
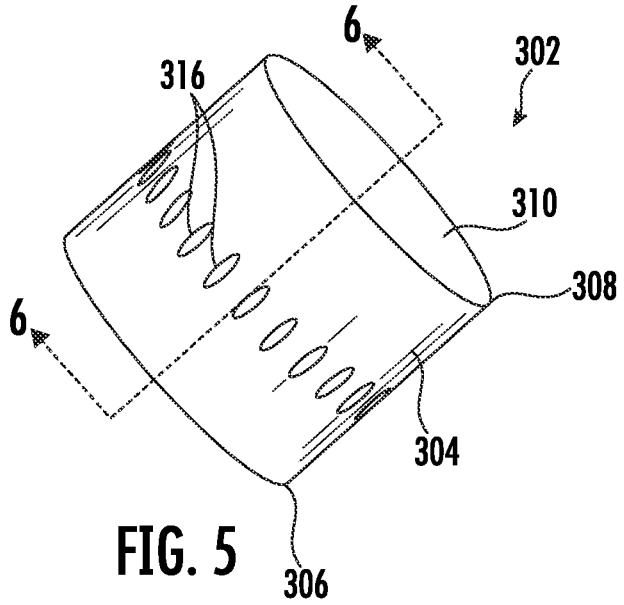
FIG. 5 illustrates a perspective view of a nozzle tip, in accordance with embodiments of the present disclosure.
Figure 6:
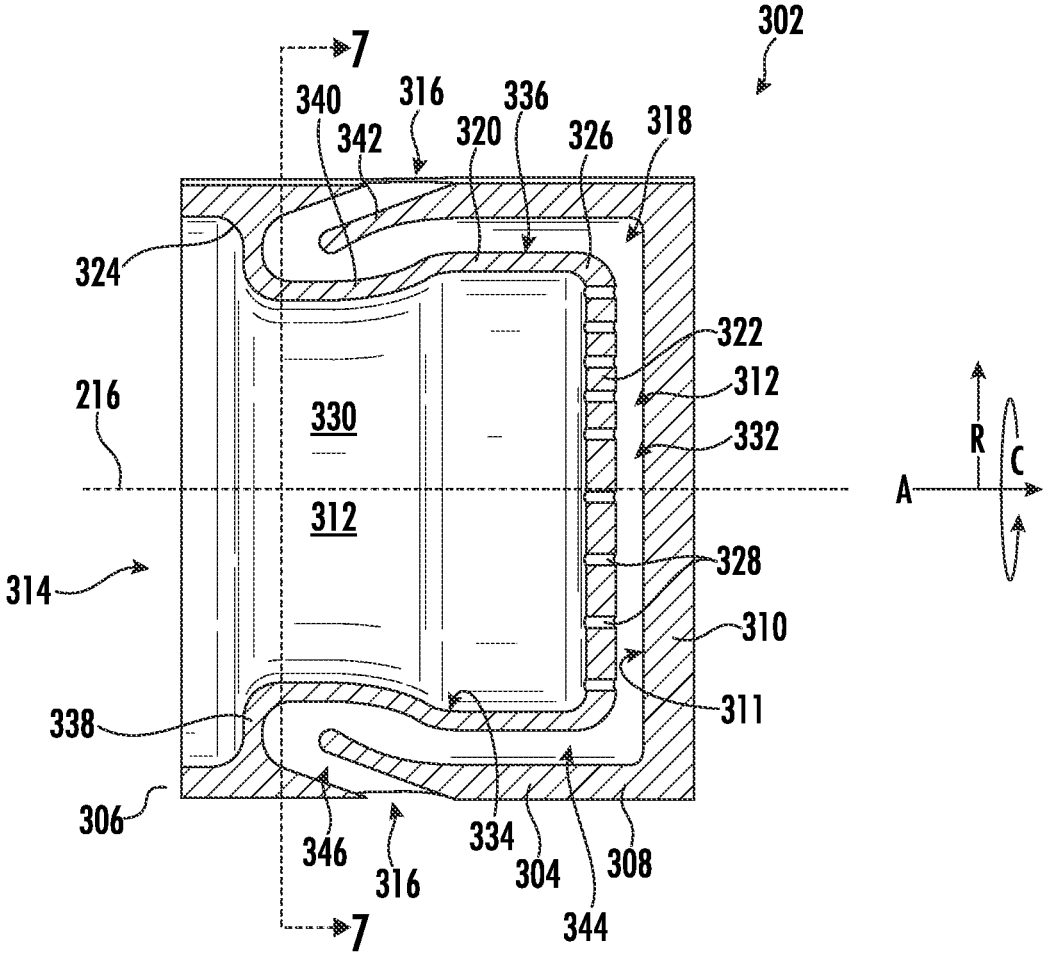
FIG. 6 illustrates a cross-sectional view of the nozzle tip from along the line 6-6 shown in FIG. 5, in accordance with embodiments of the present disclosure.

FIG. 5 illustrates a perspective view of the nozzle tip 302 isolated from the fuel nozzle 300 shown in FIG. 4, and FIG. 6 illustrates a cross-sectional view of the nozzle tip 302 from along the line 6-6 shown in FIG. 5, in accordance with embodiments of the present disclosure. As shown, the nozzle tip 302 may include an outer annular wall 304 having a forward end 306 and an aft end 308. The outer annular wall may extend axially between the forward end 306 and the aft end 308. In many embodiments, as shown best in FIG. 4, the forward end 306 of the outer annular wall 304 may be fixedly coupled to the downstream end 230 of the center body 202 (e.g., via welding, brazing, or other suitable process). As shown in FIGS. 4 and 6, a common axial centerline 216 extends through the fuel nozzle 300 and the nozzle tip 302.

In exemplary embodiments, the nozzle tip 302 may include a solid aft wall 310 disposed at the aft end 308 of the outer annular wall 304. As used herein, the term "solid" refers to a wall or walls that are impermeable, such that they do not allow air or other fluids to pass therethrough. For example, the solid aft wall 310 is not fabricated with any apertures, holes, or voids that would allow for fluid to escape or travel therethrough. In many embodiments, the solid aft wall 310 may be the aft-most portion of the nozzle tip 302, such that the nozzle tip 302 terminates axially at the solid aft wall 310. As shown in FIG. 4, the solid aft wall 310 may be disposed upstream (or forward) of the aft end 222 of the burner tube 204 (and the outlet 224 of the premix passage 208).

In many embodiments, as shown in FIG. 6, the solid aft wall 310 and the outer annular wall 304 at least partially define a plenum 312. In particular, the solid aft wall 310 and the outer annular wall 304 may be the outermost walls of the nozzle tip 302 and may collectively define the plenum 312. In many embodiments, the plenum 312 may be in direct fluid communication with the center body 202 (e.g., in direct fluid communication with the air plenum 238 defined by the center body 202). As shown, the plenum 312 may include an inlet 314 defined by the outer annular wall 304 at the forward end 306. Additionally, the plenum 312 may include a plurality of outlets 316 defined in the outer annular wall 304. For example, the plurality of outlets 316 may be circumferentially spaced apart from one another (e.g., equally circumferentially spaced apart), such that the outlets 316 advantageously deliver a uniform flow of fluid to the premix passage 208 upstream of the outlet 224 defined by the burner tube 204. In exemplary embodiments, the plurality of outlets 316 may be the only means by which the nozzle tip 302 fluidly communicates with the premix passage 208. For example, the fluid (i.e., air 28) may exit the nozzle tip 302 only via the plurality of outlets 316.

In particular embodiments, as shown in FIGS. 4 and 6, the nozzle tip 302 may include a nozzle portion 318 disposed within the plenum 312. For example, the nozzle portion 318 may extend radially inward from the outer annular wall 304 and may at least partially co-extend axially with the outer annular wall 304. Particularly, the nozzle portion 318 may only be connected at a first end 324 to the outer annular wall 304 but may otherwise be spaced apart from the outer annular wall 304 and suspended within the plenum 312.

In many embodiments, the nozzle portion 318 may include an inner annular wall 320 and an impingement wall 322. The inner annular wall 320 may extend from a first end 324 coupled to the outer annular wall 304 to a second end 326 coupled to the impingement wall 322. With the exception of the first end of the inner annular wall 320 (which is coupled to the outer annular wall 304), the inner annular wall 320 may be entirely spaced apart from the outer annular wall 304.

As shown, the impingement wall 322 may be disposed at the second end 326 of the inner annular wall 320. The impingement wall 322 may be generally parallel to the solid aft wall 310 and disposed axially forward of the solid aft wall 310 to define a gap between the impingement wall 322 and the solid aft wall 310. For example, the impingement wall 322 may be spaced apart from the solid aft wall 310 and generally parallel thereto, such that the solid aft wall 310 is uniformly cooled by impingement fluid traveling through the impingement wall 322.

In various embodiments, the impingement wall 322 may define a plurality of apertures 328 configured to direct fluid to impinge upon the solid aft wall 310. For example, the apertures 328 may be sized and oriented to direct the pre-impingement fluid (e.g., air 28) in discrete jets to impinge upon the interior surface 311 of the solid aft wall 310. The discrete jets of fluid impinge (or strike) the interior surface 311 and create a thin boundary layer of fluid over the interior surface 311, which allows for optimal heat transfer between the solid aft wall 310 and the fluid. For example, the apertures 328 may extend perpendicularly through the impingement wall 322, such that the apertures 328 may orient pre-impingement fluid perpendicularly to the surface upon which it strikes, e.g., the interior surface 311 of the solid aft wall 310.

Once the fluid has impinged upon the interior surface 311, it may be referred to as "post-impingement fluid" and/or "spent cooling fluid" because the fluid has undergone an energy transfer and therefore has different characteristics. For example, the spent cooling fluid may have a higher temperature and lower pressure than the pre-impingement fluid because the spent cooling fluid has removed heat from the solid aft wall 310 during the impingement process.

As shown in FIG. 6, the nozzle portion 318 of the nozzle tip 302 separates an inlet (or pre-impingement) portion 330 of the plenum 312 from an outlet (or post-impingement) portion 332 of the plenum 312. For example, the inlet portion 330 of the plenum 312 may extend from the inlet 314 to a forward side of the impingement wall 322, such that the inlet portion 330 receives fluid from the center body 202 via the inlet 314. The outlet portion 332 of the plenum 312 may extend from an aft side of the impingement wall 322 to the plurality of outlets 316 defined in the outer annular wall 304, such that the outlet portion 332 expels post-impingement fluid from the plenum 312 via the plurality of outlets 316. In many embodiments, the plurality of outlets 316 may disposed forward of the impingement wall 322 (i.e., nearer to the end cover 40), such that air exiting the impingement apertures 328 flows in an upstream direction (opposite the axial direction A).

In exemplary embodiments, as shown, an inner surface 334 of the nozzle portion 318 may at least partially define the inlet portion 330 of the plenum 312. Additionally, an outer surface 336 of the nozzle portion 318 may at least partially define the outlet portion 332 of the plenum 312. In many embodiments, the inlet portion 330 of the plenum 312 may be fluid communication with the outlet portion 332 of the plenum 312 via the plurality of apertures 328 defined in the impingement wall 322. For example, in particular embodiments, the inlet portion 330 of the plenum 312 may be in direct fluid communication with the outlet portion 332 of the plenum 312 via the plurality of apertures 328 defined in the impingement wall 322 (such as only via the plurality of apertures 328 in some embodiments).

As shown in FIG. 6, the inner annular wall 320 may include a radial portion 338 and an axial portion 340. The radial portion 338 may extend from the outer annular wall 304. For example, the radial portion 338 may extend generally radially from the first end 324 (which is connected to the outer annular wall 304) to the axial portion 340. The axial portion 340 may extend between the radial portion 338 and the impingement wall 322. For example, the axial portion 340 may extend generally axially from the radial portion 338 to the second end 326 (which is connected to the impingement wall 322).

In exemplary embodiments, the outer annular wall 304 of the nozzle tip 302 may include a slanted portion 342 that extends towards the radial portion 338 of the inner annular wall 320 and at least partially defines the plurality of outlets 316. For example, the slanted portion 342 may be oriented generally oblique to the axial direction A and may extend towards the nozzle portion 318. The slanted portion 342 may advantageously direct fluid exiting the nozzle portion 318 at an angle oblique to the axial direction, which may advantageously increase the mixing within the premix passage 208 prior to combustion.

Figure 7:
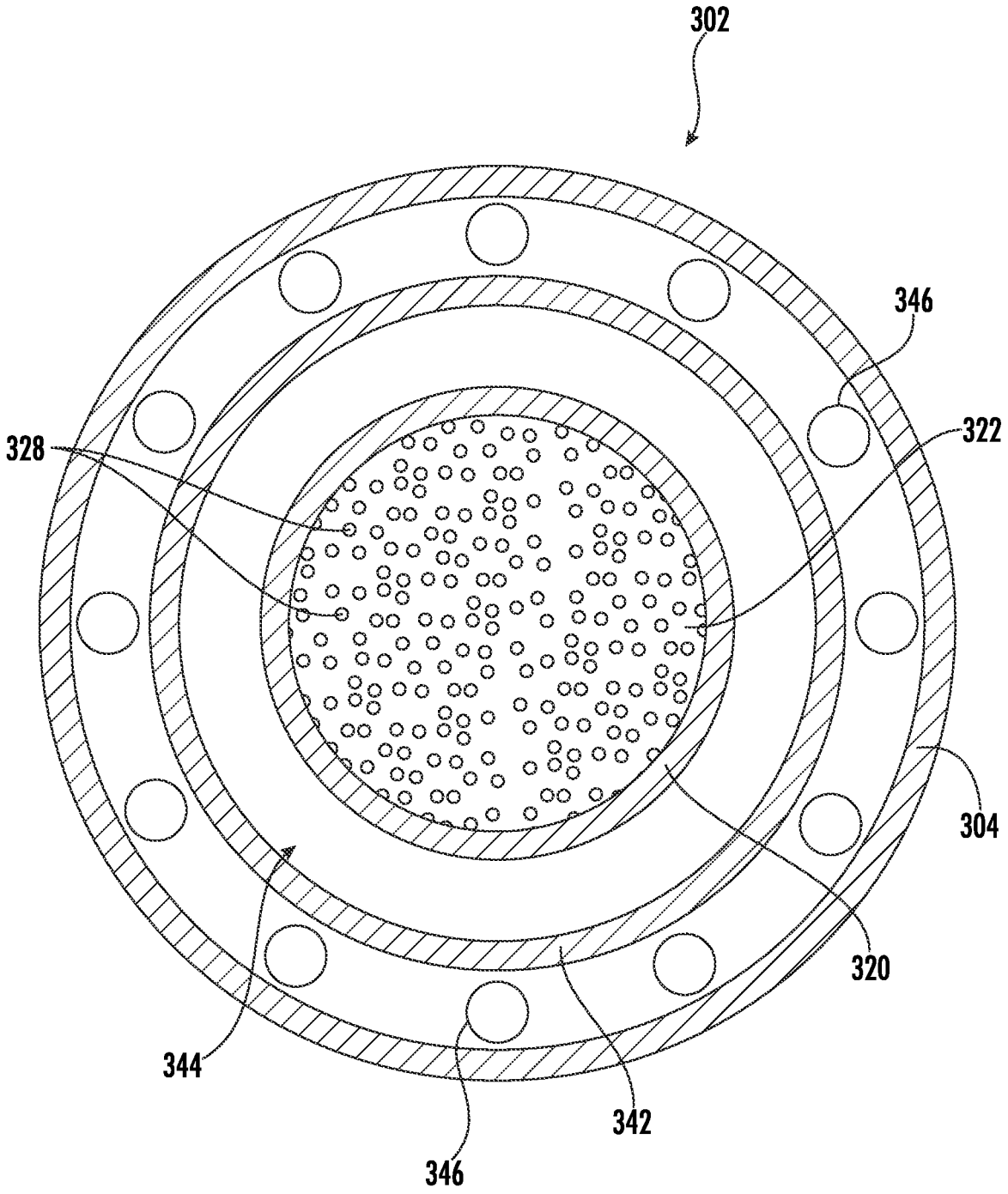
FIG. 7 illustrates a cross-sectional view of the nozzle tip from along the line 7-7 shown in FIG. 6, in accordance with embodiments of the present disclosure.

FIG. 7 illustrates a cross-sectional view of the nozzle tip 302 from along the line 7-7 shown in FIG. 6. As shown collectively by FIGS. 6 and 7, in various embodiments, the nozzle tip 302 may include an annular passage 344 defined between the inner annular wall 320 and the outer annular wall 304. The annular passage 344 provides fluid communication between the plurality of impingement apertures 328 and a plurality of outlet passages 346. The plurality of outlet passages 346 may be defined by the outer annular wall 304 (e.g., at least partially defined by the slanted portion 342 of the outer annular wall 304). For example, the plurality of outlet passages 346 may be circumferentially spaced apart from one another (e.g., equally spaced in some embodiments). In many embodiments, the plurality of outlet passages 346 may extend between the annular passage 344 and the plurality of outlets 316. For example, each outlet passage 346 may extend directly from the annular passage 344 to a respective outlet 316 of the plurality of outlets 316. In various embodiments, the plurality of outlet passages 346 may be slanted with respect to an axial centerline 216 of the fuel nozzle 300. For example, each outlet passage 346 may be at least partially defined by the slanted portion 342 of the outer annular wall 304, such that each outlet passage 346 is oriented generally oblique to the axial direction A.

In some embodiments, as shown in FIG. 7, the plurality of apertures 328 may be unevenly arranged on the impingement wall 322 (i.e., unevenly spaced apart form one another in a randomly arranged configuration). In other embodiments, the plurality of apertures 328 may be arranged such that a dense concentration of apertures 328 is located proximate the perimeter (or outer edges) of the impingement wall 322. In yet still further embodiments, the plurality of apertures 328 may arranged in an even distribution on the impingement wall 322 (such that each aperture 328 is evenly spaced apart from the neighboring apertures 328 in the plurality of apertures 328).

In many embodiments, the nozzle tip 302 described herein may be integrally formed as a single component. That is, each of the subcomponents, e.g., the outer annular wall 304, the solid aft wall 310, the nozzle portion 318, and any other subcomponent of the nozzle tip 302, may be manufactured together as a single body joined together without any internal weld or braze joints. In exemplary embodiments, this may be done by utilizing an additive manufacturing system and method, such as direct metal laser sintering (DMLS), direct metal laser melting (DMLM), or other suitable additive manufacturing techniques. By utilizing additive manufacturing methods, the nozzle tip 302 may be integrally formed as a single piece of continuous metal and may thus include fewer sub-components and/or joints compared to prior designs. The integral formation of the nozzle tip 302 through additive manufacturing may advantageously improve the overall assembly process. For example, the integral formation reduces the number of separate parts that must be assembled, thus reducing associated time and overall assembly costs. Additionally, existing issues with, for example, leakage, joint quality between separate parts, and overall performance may advantageously be reduced. Further, the integral formation of the nozzle tip 302 may favorably reduce the weight of the nozzle tip 302 as compared to other manufacturing methods.

In other embodiments, other manufacturing techniques, such as casting or other suitable techniques, may be used for some or all of the components of the nozzle tip 302.

In operation, the solid aft wall 310 may be continuously impingement cooled via fluid (air) exiting the apertures 328 defined in the impingement wall 322. Additionally, the outer annular wall 304 may experience convective cooling as the post-impingement air is conveyed through the outlet portion 332 of the plenum 312 to the outlets 316. As a result, the hardware life of the nozzle tip 302 may advantageously increase. For example, the exemplary nozzle tip 302 described herein experiences less thermal stress than prior designs, which advantageously prevents cracking or damaging to the nozzle tip 302 that may otherwise occur.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

According to a first aspect, a fuel nozzle for a turbomachine is provided, the fuel nozzle comprising: a center body extending from an upstream end to a downstream end; and a nozzle tip fixedly coupled to the downstream end of the center body, the nozzle tip comprising: an outer annular wall having a forward end and an aft end, the forward end of the outer annular wall fixedly coupled to the downstream end of the center body; a solid aft wall disposed at the aft end of the outer annular wall, the solid aft wall and the outer annular wall at least partially defining a plenum; and a nozzle portion disposed within the plenum, the nozzle portion including an inner annular wall and an impingement wall, the impingement wall spaced apart from the solid aft wall and defining a plurality of apertures configured to direct fluid to impinge upon the solid aft wall, wherein a plurality of outlets is defined in the outer annular wall to direct post-impingement fluid from the nozzle tip.

The fuel nozzle as in one or more of these clauses, wherein the plurality of outlets is disposed forward of the impingement wall.

The fuel nozzle as in one or more of these clauses, wherein the inner annular wall includes a radial portion and an axial portion, the radial portion extending from the outer annular wall and the axial portion extending between the radial portion and the impingement wall.

The fuel nozzle as in one or more of these clauses, further comprising an annular passage defined between the inner annular wall and the outer annular wall, the annular passage providing fluid communication between the plurality of apertures and a plurality of outlet passages, the plurality of outlet passages extending between the annular passage and the plurality of outlets.

The fuel nozzle as in one or more of these clauses, wherein the plurality of outlet passages is slanted with respect to an axial centerline of the fuel nozzle.

The fuel nozzle as in one or more of these clauses, wherein the nozzle portion of the nozzle tip separates an inlet portion of the plenum from an outlet portion of the plenum; wherein the inlet portion of the plenum is in fluid communication with the outlet portion of the plenum via the plurality of apertures defined in the impingement wall.

The fuel nozzle as in one or more of these clauses, wherein the center body defines a fuel passage and an air plenum fluidly isolated from one another, and wherein a partition is disposed within the center body and forms a boundary between the fuel passage and the air plenum.

The fuel nozzle as in one or more of these clauses, further comprising: a plurality of turning vanes that extends radially outward from the center body, each turning vane including at least one fuel port, each fuel port being in fluid communication with the fuel passage; and a burner tube circumferentially surrounding a portion of the center body, wherein the burner tube and the center body define a premix passage therebetween, wherein the plurality of turning vanes extends radially between the center body and the burner tube within the premix passage.

The fuel nozzle as in one or more of these clauses, wherein the nozzle tip is disposed within the burner tube such that the solid aft wall is axially forward of a downstream end of the burner tube.

The fuel nozzle as in one or more of these clauses, a plurality of conduits in fluid communication with the air plenum, each conduit being collectively defined by the burner tube, a turning vane of the plurality of turning vanes, and the center body.

According to another aspect, a combustor is provided, the combustor comprising: an end cover; and at least one fuel nozzle connected to the end cover and extending downstream from the end cover, the at least one fuel nozzle comprising: a center body extending from an upstream end to a downstream end; and a nozzle tip fixedly coupled to the downstream end of the center body, the nozzle tip comprising: an outer annular wall having a forward end and an aft end, the forward end of the outer annular wall fixedly coupled to the downstream end of the center body; a solid aft wall disposed at the aft end of the outer annular wall, the solid aft wall and the outer annular wall at least partially defining a plenum; and a nozzle portion disposed within the plenum, the nozzle portion including an inner annular wall and an impingement wall, the impingement wall spaced apart from the solid aft wall and defining a plurality of apertures configured to direct fluid to impinge upon the solid aft wall, wherein a plurality of outlets is defined in the outer annular wall to direct post-impingement fluid from the nozzle tip.

The combustor as in one or more of these clauses, wherein the plurality of outlets is disposed forward of the impingement wall.

The combustor as in one or more of these clauses, wherein the inner annular wall includes a radial portion and an axial portion, the radial portion extending from the outer annular wall and the axial portion extending between the radial portion and the impingement wall.

The combustor as in one or more of these clauses, further comprising an annular passage defined between the inner annular wall and the outer annular wall, the annular passage providing fluid communication between the plurality of apertures and a plurality of outlet passages, the plurality of outlet passages extending between the annular passage and the plurality of outlets.

The combustor as in one or more of these clauses, wherein the plurality of outlet passages is slanted with respect to an axial centerline of the fuel nozzle.

The combustor as in one or more of these clauses, wherein the nozzle portion of the nozzle tip separates an inlet portion of the plenum from an outlet portion of the plenum; wherein the inlet portion of the plenum is in fluid communication with the outlet portion of the plenum via the plurality of apertures defined in the impingement wall.

The combustor as in one or more of these clauses, wherein the center body defines a fuel passage and an air plenum fluidly isolated from one another, and wherein a partition is disposed within the center body and forms a boundary between the fuel passage and the air plenum.

The combustor as in one or more of these clauses, further comprising: a plurality of turning vanes that extends radially outward from the center body, each turning vane including at least one fuel port, each fuel port being in fluid communication with the fuel passage; and a burner tube circumferentially surrounding a portion of the center body, wherein the burner tube and the center body define a premix passage therebetween, wherein the plurality of turning vanes extends radially between the center body and the burner tube within the premix passage.

The combustor as in one or more of these clauses, wherein the nozzle tip is disposed within the burner tube such that the solid aft wall is axially forward of a downstream end of the burner tube.

The combustor as in one or more of these clauses, a plurality of conduits in fluid communication with the air plenum, each conduit being collectively defined by the burner tube, a turning vane of the plurality of turning vanes, and the center body.

What is claimed is:

1. A fuel nozzle for a turbomachine, the fuel nozzle comprising:

a center body extending from an upstream end to a downstream end; and a nozzle tip fixedly coupled to the downstream end of the center body, the nozzle tip comprising:

an outer annular wall having a forward end and an aft end, the forward end of the outer annular wall fixedly coupled to the downstream end of the center body;

a solid aft wall disposed at the aft end of the outer annular wall, the solid aft wall and the outer annular wall at least partially defining a plenum; and a nozzle portion disposed within the plenum, the nozzle portion including an inner annular wall and an impingement wall, the impingement wall spaced apart from the solid aft wall and defining a plurality of apertures configured to direct fluid to impinge upon the solid aft wall, wherein the outer annular wall includes a slanted portion that extends inward towards the inner annular wall, and wherein a plurality of outlets is defined in the outer annular wall to direct post-impingement fluid from the nozzle tip.

2. The fuel nozzle as in claim 1, wherein the plurality of outlets is disposed forward of the impingement wall.

3. The fuel nozzle as in claim 1, wherein the inner annular wall includes a radial portion and an axial portion, the radial portion disposed forward of the slanted portion, the radial portion extending from the outer annular wall and the axial portion extending between the radial portion and the impingement wall.

4. The fuel nozzle as in claim 1, further comprising an annular passage defined between the inner annular wall and the outer annular wall, the annular passage providing fluid communication between the plurality of apertures and a plurality of outlet passages, the plurality of outlet passages at least partially defined by the slanted portion and extending between the annular passage and the plurality of outlets.

5. The fuel nozzle as in claim 4, wherein the plurality of outlet passages is slanted with respect to an axial centerline of the fuel nozzle.

6. The fuel nozzle as in claim 1, wherein the nozzle portion of the nozzle tip separates an inlet portion of the plenum from an outlet portion of the plenum; wherein the inlet portion of the plenum is in fluid communication with the outlet portion of the plenum via the plurality of apertures defined in the impingement wall.

7. The fuel nozzle as in claim 1, wherein the center body defines a fuel passage and an air plenum fluidly isolated from one another, and wherein a partition is disposed within the center body and forms a boundary between the fuel passage and the air plenum.

8. The fuel nozzle as in claim 7, further comprising:

a plurality of turning vanes that extends radially outward from the center body, each turning vane including at least one fuel port, each fuel port being in fluid communication with the fuel passage; and a burner tube circumferentially surrounding a portion of the center body, wherein the burner tube and the center body define a premix passage therebetween, wherein the plurality of turning vanes extends radially between the center body and the burner tube within the premix passage.

9. The fuel nozzle as in claim 8, wherein the nozzle tip is disposed within the burner tube such that the solid aft wall is axially forward of a downstream end of the burner tube.

10. The fuel nozzle as in claim 8, further comprising a plurality of conduits in fluid communication with the air plenum, each conduit being collectively defined by the burner tube, a turning vane of the plurality of turning vanes, and the center body.

11. A combustor, comprising:

an end cover; and at least one fuel nozzle connected to the end cover and extending downstream from the end cover, the at least one fuel nozzle comprising:

a center body extending from an upstream end to a downstream end; and a nozzle tip fixedly coupled to the downstream end of the center body, the nozzle tip comprising:

an outer annular wall having a forward end and an aft end, the forward end of the outer annular wall fixedly coupled to the downstream end of the center body;

a solid aft wall disposed at the aft end of the outer annular wall, the solid aft wall and the outer annular wall at least partially defining a plenum; and a nozzle portion disposed within the plenum, the nozzle portion including an inner annular wall and an impingement wall, the impingement wall spaced apart from the solid aft wall and defining a plurality of apertures configured to direct fluid to impinge upon the solid aft wall, wherein the outer annular wall includes a slanted portion that extends inward towards the inner annular wall, and wherein a plurality of outlets is defined in the outer annular wall to direct post-impingement fluid from the nozzle tip.

12. The combustor as in claim 11, wherein the plurality of outlets is disposed forward of the impingement wall.

13. The combustor as in claim 11, wherein the inner annular wall includes a radial portion and an axial portion, the radial portion disposed forward of the slanted portion, the radial portion extending from the outer annular wall and the axial portion extending between the radial portion and the impingement wall.

14. The combustor as in claim 11, further comprising an annular passage defined between the inner annular wall and the outer annular wall, the annular passage providing fluid communication between the plurality of apertures and a plurality of outlet passages, the plurality of outlet passages at least partially defined by the slanted portion and extending between the annular passage and the plurality of outlets.

15. The combustor as in claim 14, wherein the plurality of outlet passages is slanted with respect to an axial centerline of the fuel nozzle.

16. The combustor as in claim 11, wherein the nozzle portion of the nozzle tip separates an inlet portion of the plenum from an outlet portion of the plenum; wherein the inlet portion of the plenum is in fluid communication with the outlet portion of the plenum via the plurality of apertures defined in the impingement wall.

17. The combustor as in claim 11, wherein the center body defines a fuel passage and an air plenum fluidly isolated from one another, and wherein a partition is disposed within the center body and forms a boundary between the fuel passage and the air plenum.

18. The combustor as in claim 17, further comprising:

a plurality of turning vanes that extends radially outward from the center body, each turning vane including at least one fuel port, each fuel port being in fluid communication with the fuel passage; and a burner tube circumferentially surrounding a portion of the center body, wherein the burner tube and the center body define a premix passage therebetween, wherein the plurality of turning vanes extends radially between the center body and the burner tube within the premix passage.

19. The combustor as in claim 18, wherein the nozzle tip is disposed within the burner tube such that the solid aft wall is axially forward of a downstream end of the burner tube.

20. The combustor as in claim 18, further comprising a plurality of conduits in fluid communication with the air plenum, each conduit being collectively defined by the burner tube, a turning vane of the plurality of turning vanes, and the center body.

* * * * *